US009909467B2

(12) United States Patent
Son et al.

(10) Patent No.: US 9,909,467 B2
(45) **Date of Patent: *Mar. 6, 2018**

(54) CONTINUOUS VARIABLE VALVE TIMING APPARATUS AND ENGINE PROVIDED WITH THE SAME

(71) Applicant: Hyundai Motor Company, Seoul (KR)

(72) Inventors: You Sang Son, Suwon-si (KR); Kyoung Pyo Ha, Seongnam-si (KR); Back Sik Kim, Osan-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/940,482

(22) Filed: Nov. 13, 2015

(65) Prior Publication Data

US 2016/0160698 A1 Jun. 9, 2016

(30) Foreign Application Priority Data

Dec. 9, 2014 (KR) ..... 10-2014-0175839

(51) Int. Cl.

| | |
|---|---|
| ***F01L 1/34*** | (2006.01) |
| ***F01L 1/352*** | (2006.01) |
| ***F01L 1/08*** | (2006.01) |
| *F01L 1/047* | (2006.01) |

(52) U.S. Cl.

CPC ..... *F01L 1/352* (2013.01); *F01L 1/08* (2013.01); *F01L 1/047* (2013.01); *F01L 2001/0473* (2013.01)

(58) Field of Classification Search

CPC ... F01L 1/08; F01L 1/352; F01L 1/047; F01L 2001/0473

USPC ..... 123/90.15, 90.16, 90.17, 90.44, 90.6

See application file for complete search history.

(56) References Cited

U.S. PATENT DOCUMENTS

| | | | | |
|---|---|---|---|---|
| 5,924,334 | A | 7/1999 | Hara et al. | |
| 7,721,691 | B2 | 5/2010 | Tateno | |
| 9,512,748 | B2 * | 12/2016 | Kim | F01L 1/356 123/90.16 |
| 2010/0059005 | A1 | 3/2010 | Stone et al. | |

FOREIGN PATENT DOCUMENTS

| | | | |
|---|---|---|---|
| JP | 6-185321 | A | 7/1994 |
| JP | 2009-236010 | A | 10/2009 |
| KR | 10-2013-0063819 | A | 6/2013 |
| KR | 10-1326818 | B1 | 11/2013 |

* cited by examiner

*Primary Examiner* — Ching Chang

(74) *Attorney, Agent, or Firm* — Morgan, Lewis & Bockius LLP

(57) ABSTRACT

A continuously variable valve timing apparatus may include a camshaft, a plurality of wheels mounted to the camshaft, of which a wheel key is formed thereto respectively, a plurality of cam portions of which a cam and a cam key are formed thereto respectively, of which the camshaft is inserted thereto, of which relative phase angle with respect to the camshaft is variable, a plurality of inner brackets connected with the each wheel key and the each cam key, a plurality of a slider housings of which the each inner bracket is rotatably inserted thereto respectively, and rotatably configured around a hinge hole formed an upper side of a cam cap and a control portion selectively moving the slider housings to change relative position of a rotation center of the inner brackets.

16 Claims, 8 Drawing Sheets

CONTINUOUS VARIABLE VALVE TIMING APPARATUS AND ENGINE PROVIDED WITH THE SAME

CROSS-REFERENCE TO RELATED APPLICATION

The present application claims priority to and the benefit of Korean Patent Application No. 10-2014-0175839 filed on Dec. 9, 2014, the entire contents of which is incorporated herein for all purposes by this reference.

BACKGROUND OF THE INVENTION

Field of the Invention

The present invention relates to a continuously variable valve timing apparatus and an engine provided with the same. More particularly, the present invention relates to a continuously variable valve timing apparatus and an engine provided with the same which may vary opening timing of a valve according to operation conditions of an engine with a simple construction.

Description of Related Art

An internal combustion engine generates power by burning fuel in a combustion chamber in an air media drawn into the chamber. Intake valves are operated by a camshaft to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. To achieve such optimal valve operation depending on the rotation speed of the engine, various researches, such as designing of a plurality of cams and a continuous variable valve lift (CVVL) that can change valve lift according to engine speed, have been undertaken.

Also, to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directly providing a continuous variable valve timing apparatus and an engine provided with the same which may vary valve timing according to operation conditions of an engine, with a simple construction.

According to various aspects of the present invention, a continuous variable valve timing apparatus may include a camshaft, a plurality of wheels mounted to the camshaft, of which a wheel key is formed thereto respectively, a plurality of cam portions of which a cam and a cam key are formed thereto respectively, of which the camshaft is inserted thereto, of which relative phase angle with respect to the camshaft is variable, a plurality of inner brackets connected with the each wheel key and the each cam key, a plurality of a slider housings of which the each inner bracket is rotatably inserted thereto respectively, and rotatably configured around a hinge hole formed an upper side of a cam cap and a control portion selectively moving the slider housings to change relative position of a rotation center of the inner brackets.

The continuous variable valve timing apparatus may further include first pins of which a wheel key slot, the each wheel key is slidably inserted thereto, is formed thereto respectively and second pins of which a cam key slot, the each cam key is slidably inserted thereto, is formed thereto respectively, and a first sliding pin hole and a second sliding pin hole, of which the first pin and the second pin are inserted thereto respectively, may be formed to the inner bracket.

The first pin and the second pin may be formed as a circular cylinder shape and the first sliding pin hole and the second sliding pin hole may be formed for the first pin and the second pin to be rotated within thereto.

The wheel key slot of the first pin and the cam key slot of the second pin may be formed opposite direction.

Parts of the first sliding pin hole and the second sliding pin hole may be opened for movements of the wheel key and the cam key not to be interrupted.

The continuous variable timing apparatus may further include a bearing inserted between the slider housing and the inner bracket.

The slider housings may be connected each other through a slider housing connecting rod and a connecting bracket and a hinge pin, inserted into the hinge hole, may be connected the connecting bracket.

The control portion may include a control gear connected to the slider housing and a control motor engaged with the control gear.

The control gear may be disposed under the slider housing.

A stopper may be formed to the slider housing for limiting movement of the slider housing.

According to various aspects of the present invention, an a camshaft, a plurality of wheels mounted to the camshaft, of which a wheel key is formed thereto respectively, and disposed corresponding to each cylinder, a plurality of cam portions of which a cam and a cam key are formed thereto respectively, of which the camshaft is inserted thereto, of which relative phase angle with respect to the camshaft is variable and disposed corresponding to the each cylinder, a plurality of inner brackets of which a first sliding pin hole and a second sliding pin hole, connected with the each wheel key and the each cam key; are formed respectively thereto, a plurality of a slider housings of which the each inner bracket is rotatably inserted thereto, and rotatably configured around a hinge hole formed to au upper side of a cam cap, first pins of which a wheel key slot, the each wheel key is slidably inserted thereto, is formed thereto respectively and rotatably inserted into the first sliding pin hole, second pins of which a cam key slot, the each the cam key is slidably inserted thereto, is formed thereto opposite to the wheel key sloto respectively, and rotatably inserted into the second sliding pin hole and a control portion selectively moving the slider housings to change relative position of a rotation center of the inner brackets.

Parts of the first sliding pin hole and the second sliding pin hole may be opened for movements of the wheel key and the cam key not to be interrupted.

The engine may further include a bearing inserted between the slider housing and the inner bracket.

The slider housings may be connected each other through a slider housing connecting rod and a connecting bracket and a hinge pin, inserted into the hinge hole, may be connected the connecting bracket.

The control portion may include a control gear connected to the slider housing and a control motor engaged with the control gear and selectively rotating the control gear.

A stopper may be formed to the slider housing for limiting movement of the slider housing.

As described above, a continuous variable valve timing apparatus may vary valve timing according to operation conditions of an engine, with a simple construction.

The continuous variable valve timing apparatus may be reduced in size and thus the entire height of a valve train may be reduced.

Since the continuous variable valve timing apparatus is applied to an existing engine without excessive modification, thus productivity is enhance and production cost may be reduced.

The methods and apparatuses of the present invention have other features and advantages which will be apparent from or are set forth in more detail in the accompanying drawings, which are incorporated herein, and the following Detailed Description, which together serve to explain predetermined principles of the present invention.

Figure 1:
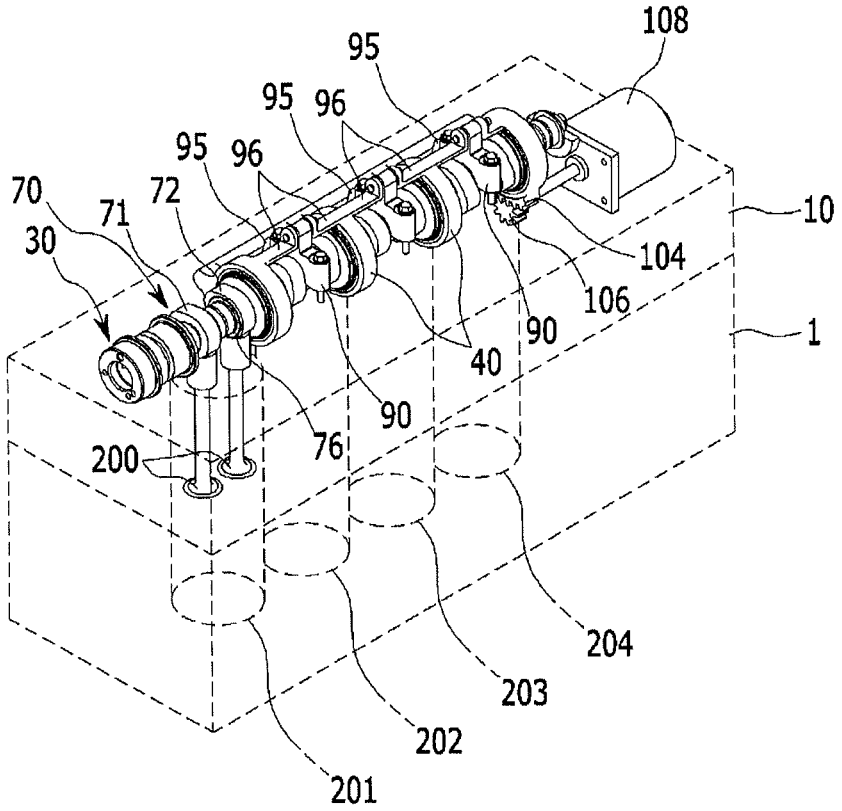
FIG. 1 is a perspective view of an engine provided with a continuous variable valve timing apparatus according to an exemplary embodiment of the present invention.

It should be understood that the appended drawings are not necessarily to scale, presenting a somewhat simplified representation of various features illustrative of the basic principles of the invention. The predetermined design features of the present invention as disclosed herein, including, for example, predetermined dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) may be intended to cover not only the exemplary embodiments, but further various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
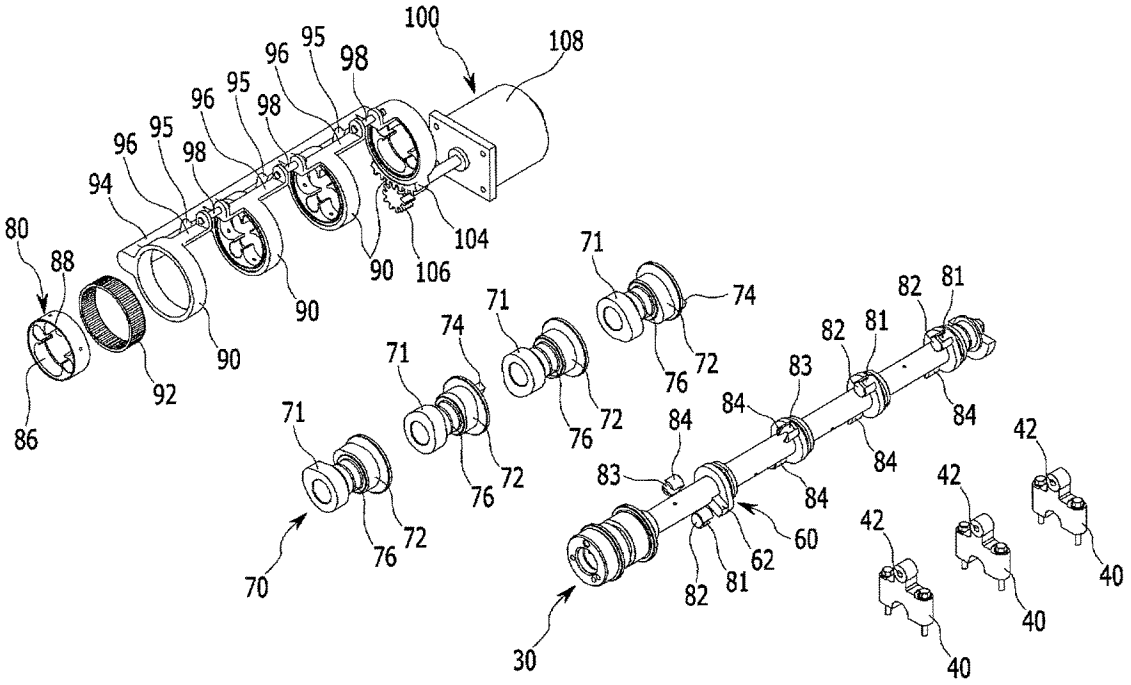
FIG. 2 is an exploded perspective view of a continuous variable valve timing apparatus according to an exemplary embodiment of the present invention.
Figure 3:
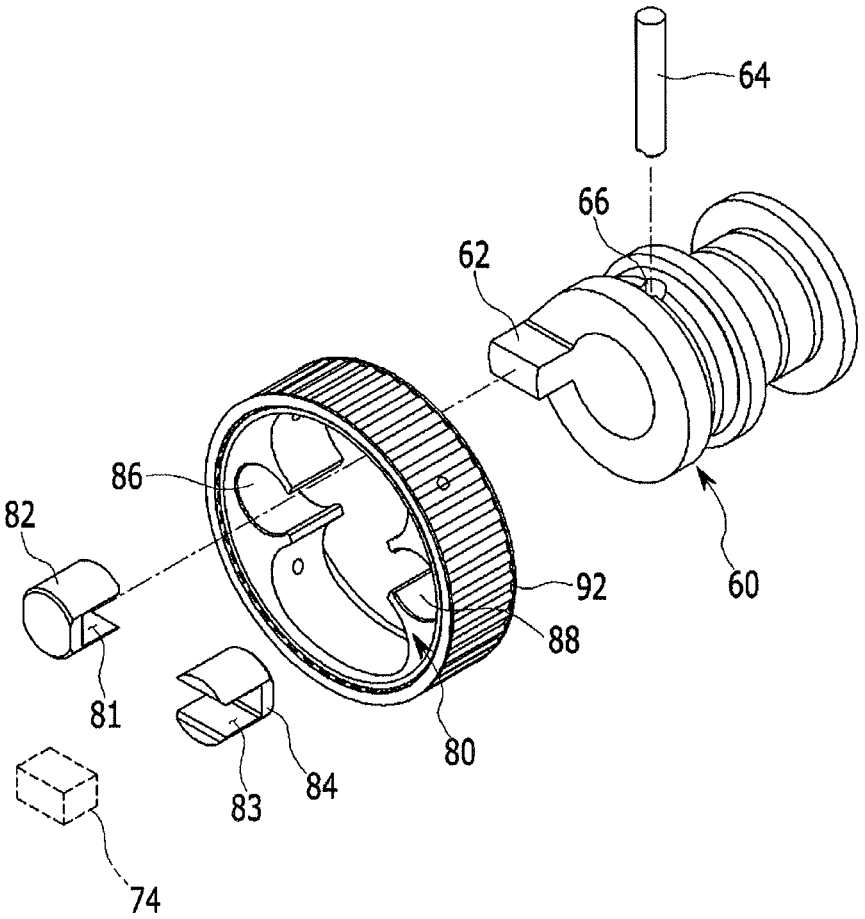
FIG. 3 and FIG. 4 are partial exploded perspective views of a continuous variable valve timing apparatus according to an exemplary embodiment of the present invention.
Figure 4:
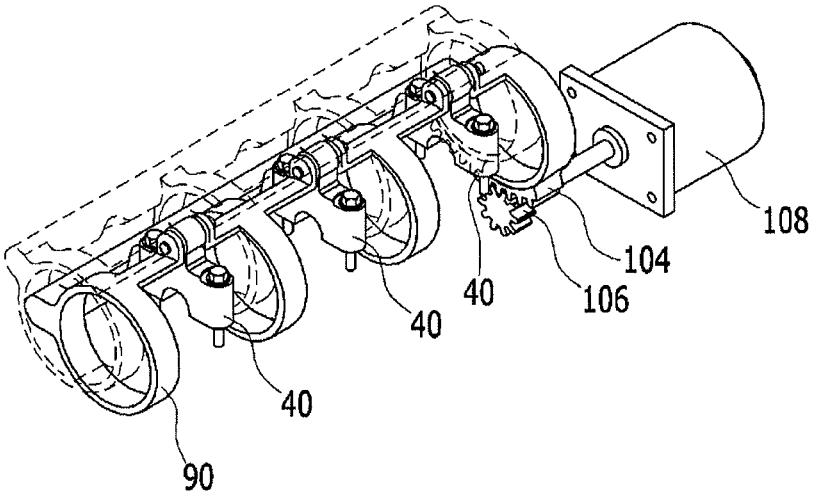

FIG. 1 is a perspective view of an engine provided with a continuous variable valve timing apparatus, FIG. 2 is an exploded perspective view of a continuous variable valve timing apparatus, and FIG. 3 and FIG. 4 are partial exploded perspective views of a continuous variable valve timing apparatus.

FIG. 1 to referring to FIG. 4, an engine includes an engine block 1, and a cylinder head 10 disposed on the engine block 1 and a continuous variable valve timing apparatus mounted to the cylinder head 10.

The continuous variable valve timing apparatus includes a camshaft 30, a plurality of wheels 60 mounted to the camshaft 30, of which a wheel key 62 is formed thereto respectively, a plurality of cam portions 70 of which a cam 71 and/or 72 and a cam key 74 are formed thereto respectively, of which the camshaft 30 is inserted thereto, of which relative phase angle with respect to the camshaft 30 is variable, a plurality of inner brackets 80 connected with the each wheel key 62 and the each cam key 74, a plurality of a slider housings 90 of which the each inner bracket 80 is rotatably inserted thereto respectively, and rotatably configured around a hinge hole 42 formed an upper side of a cam cap 40 and a control portion 100 selectively moving the slider housings 90 to change relative position of a rotation center of the inner brackets 80.

The camshaft 30 may be an intake camshaft or an exhaust camshaft.

In the drawing, the cam 71 and 72 is formed as a pair, but it is not limited thereto.

While a cam cap engaging portion 76 is formed between the cams 71 and 72 in the drawings, but it is not limited thereto.

The cams 71 and/or 72 contacts to open valve 200.

The engine includes a plurality of cylinders 201, 202, 203 and 204, and the plurality of wheels 60 and the plurality of the cam portions are disposed corresponding to the each cylinder 201, 202, 203 and 204 respectively.

In the drawing, 4 cylinders are formed to the engine, but it is not limited thereto.

A wheel hole 66 is formed to the wheel 60, and a connecting pin 64 is inserted into the wheel hole 66 for the wheel 60 to be connected with the camshaft 30.

The continuously variable valve timing apparatus further includes first pins 82 of which a wheel key slot 81, the each wheel key 62 is slidably inserted thereto, is formed thereto respectively and second pins 84 of which a cam key slot 83, the each the cam key 74 is slidably inserted thereto, is formed thereto respectively. And a first sliding pin hole 86 and a second sliding pin hole 88, of which the first pin 82 and the second pin 84 are inserted thereto respectively are formed to the inner bracket 80.

The first pin 82 and the second pin 84 are formed as a circular cylinder shape and the first sliding pin hole 86 and the second sliding pin hole 88 are formed for the first pin 82 and the second pin 84 to be rotated within thereto. Since the first pin 82, the second pin 84, the first sliding pin hole 86 and the second sliding pin hole 88 are formed as a circular cylinder, thus wear resistance may be enhanced.

Also, productivity may be increased due to simple shapes of the first pin 82, the second pin 84, the first sliding pin hole 86 and the second sliding pin hole 88.

The wheel key slot 81 of the first pin 82 and the cam key slot 83 of the second pin 84 are formed opposite direction.

Parts of the first sliding pin hole 86 and the second sliding pin hole 88 are opened for movements of the wheel key 62 and the cam key 74 not to be interrupted.

A bearing 92 is inserted between the slider housing 90 and the inner bracket 80. Thus, rotation of the inner bracket 80 may be easily performed.

In the drawings, the bearing 92 is depicted as a needle bearing, however it is not limited thereto. On the contrary, various bearings such as a ball bearing, a roller bearing and so on may be applied thereto.

The slider housings 90 are connected each other through a slider housing connecting rod 94 and a connecting bracket 96. Thus rotation positions of the slider housings 90 are integrally controlled and stably assembled.

A hinge pin 98, inserted into the hinge hole 42, is connected the connecting bracket 96.

Figure 5:
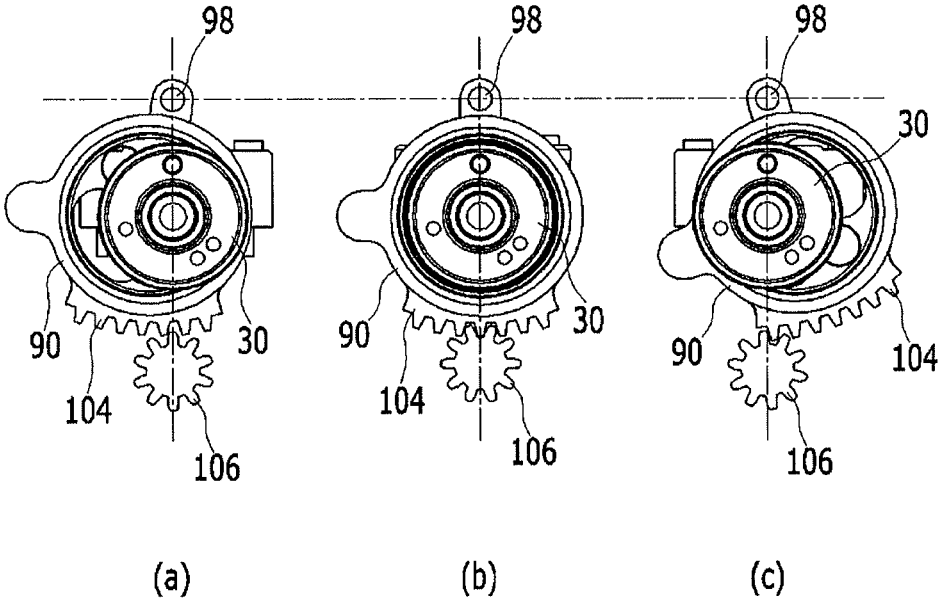
FIG. 5 is a drawing showing operations of a continuous variable valve timing apparatus according to an exemplary embodiment of the present invention.

FIG. 5 is a drawing showing operations of a continuous variable valve timing apparatus.

Referring to FIG. 1 to FIG. 5, the control portion 100 includes a control gear 104 connected to the slider housing 90 and a control motor 108 selectively rotating a motor gear engaged with the control gear 104.

According to engine operation states, an ECU (engine control unit or electric control unit) transmits control signals to the motor 108 of the control portion 100 to change a relative position of the slider housing 90. For example, a relative position of the slider housing 90 is change along left and right direction of an engine.

As shown in (b) of FIG. 5, since the rotation center of the inner bracket 80 coincides with the rotation center of the cam shaft 30, relative speed change of the cam 71 and 72 with respect to rotation speed of the camshaft 30 is not occurred. That is, the cam 71 and 72 and the camshaft 30 rotate with a same rotational speed.

According to engine operation states, an ECU (engine control unit or electric control unit) transmits control signals to the motor 108 of the control portion 100 to change a relative position of the slider housing 90.

For example, as shown in (a) and (c) of FIG. 5, when the motor 108 rotates the motor gear 106 for the slider housing 90 and the inner bracket 80 to be moved, the rotation center of the inner bracket 80 moves with respect to the rotation center of the camshaft 30 to left or right direction. Then relative phase of the cam portion 70 with respect to the camshaft 30 is changed.

Figure 6:
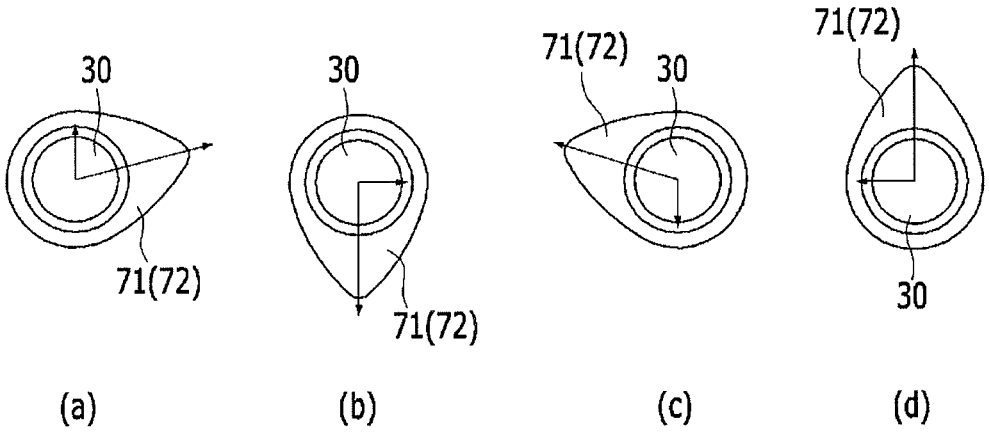
FIG. 6 and FIG. 7 are drawings showing mechanical motions of cams of a continuous variable valve timing apparatus according to an exemplary embodiment of the present invention.
Figure 7:
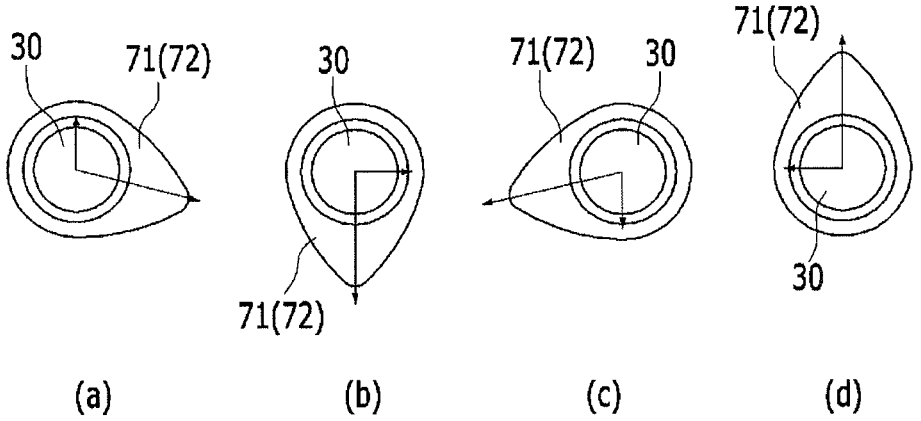

FIG. 6 and FIG. 7 are drawings showing mechanical motions of cams of a continuous variable valve timing apparatus.

As shown in (a) of FIG. 5, when the rotation center of the cam 71 and 72 with respect to the rotation center of the camshaft 30 moves to the left, the rotation speed of the cams 71 and 72 is relatively faster than rotation speed of the camshaft 30 from phase a to phase b and from phase b to phase c, then the rotation speed of the cams 71 and 82 is relatively slower than rotation speed of the camshaft 30 from phase c to phase d and from phase d to phase a as shown in FIG. 6.

As shown in (c) of FIG. 5, when the rotation center of the cam 71 and 72 with respect to the rotation center of the camshaft 30 moves to the right, the rotation speed of the cams 71 and 72 is relatively slower than rotation speed of the camshaft 30 from phase a to phase b and from phase b to phase c, then the rotation speed of the cams 71 and 82 is relatively faster than rotation speed of the camshaft 30 from phase c to phase d and from phase d to phase a as shown in FIG. 7.

While the wheel 60 is rotated together with the camshaft 30, the wheel key 62 is slidable within the wheel key slot 81, the first pin 82 and the second pin 84 are rotatable within the first sliding pin hole 86 and the second sliding pin hole 88 respectively and the cam key 74 is slidable within the cam key slot 83. Thus, when the relative rotation centers of the inner bracket 80 and the camshaft 30 are changed, the relative rotation speed of the cams 71 and 72 with respect to the rotation speed of the camshaft 30 is changed.

Figure 8:
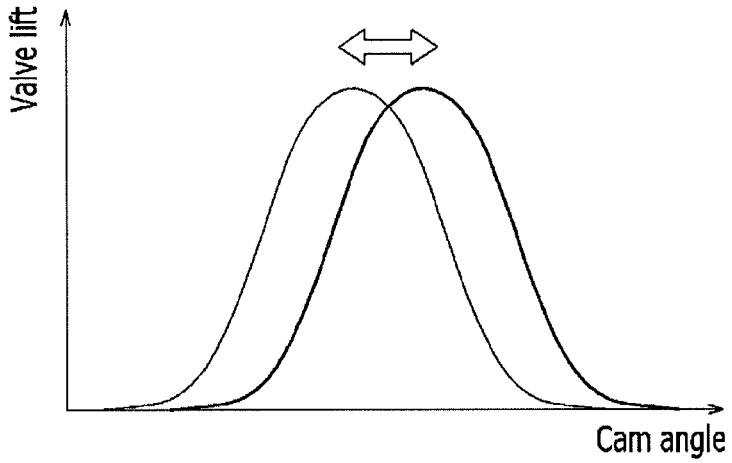
FIG. 8 is a graph of a valve profile of a continuous variable valve timing apparatus according to an exemplary embodiment of the present invention.

FIG. 8 is a graph of a valve profile of a continuous variable valve timing apparatus.

As shown in FIG. 8, although maximum lift of the valve 200 is constant, however rotation speed of the cam 71 and 72 with respect to the rotation speed of the camshaft 30 is changed according to relative positions of the slider housing 90 so that valve timing is changed and various valve profile or valve timing may be performed.

As an example shown in FIG. 8, duration of the valve 200 is constant and opening and closing time of the valve 200 is uniformly controlled, however, it is not limited thereto. According to mounting angle of the valve 200 and so on, various valve timing may be performed.

As described above, a continuous variable valve timing apparatus may vary valve timing according to operation conditions of an engine, with a simple construction.

The continuous variable valve timing apparatus may be reduced in size and thus the entire height of a valve train may be reduced.

Since the continuous variable valve timing apparatus is applied to an existing engine without excessive modification, thus productivity is enhance and production cost is reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of predetermined exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain predetermined principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve timing apparatus comprising:

a camshaft;

a plurality of wheels mounted to the camshaft, wherein a wheel key is formed to each wheel of the plurality of wheels;

a plurality of cam portions, wherein a cam and a cam key are formed to each cam portion of the plurality of cam portions, and wherein the camshaft is inserted to each cam of the plurality of cam portions;

a plurality of inner brackets connected with each wheel key of the plurality of wheels and each cam key of the plurality of cam portions;

a plurality of slider housings, wherein each inner bracket is rotatably inserted into the slider housings, and wherein the slider housings are rotatable around a hinge hole formed to an upper side of a cam cap; and a control portion configured for selectively moving the slider housings to change a position of a rotation center of the each inner bracket around the hinge hole.

2. The continuously variable valve timing apparatus of claim 1, wherein the continuously variable valve timing apparatus includes:

first pins, wherein a wheel key slot is formed to the first pins, and wherein the each wheel key is slidably inserted to the wheel key slot; and second pins, wherein a cam key slot is formed to the second pins, and wherein the each cam key is slidably inserted to the cam key slot, and wherein a first sliding pin hole and a second sliding pin hole, into which each first pin and each second pin are inserted, are formed to the each inner bracket.

3. The continuously variable valve timing apparatus of claim 2, wherein the first pins and the second pins are formed as a circular cylinder shape; and wherein the each first sliding pin hole and the each second sliding pin hole are formed for the each first pin and the each second pin to be rotated within thereto.

4. The continuously variable valve timing apparatus of claim 3, wherein the wheel key slot of the each first pin and the cam key slot of the each second pin are formed opposite direction.

5. The continuously variable valve timing apparatus of claim 4, wherein parts of the each first sliding pin hole and the each second sliding pin hole are opened for movements of the wheel key and the cam key not to be interrupted.

6. The continuously variable valve timing apparatus of claim 1, further comprising:

a bearing inserted between respective slider housing and the respective inner bracket.

7. The continuously variable valve timing apparatus of claim 1, wherein the slider housings are connected each other through a slider housing connecting rod and a connecting bracket; and wherein a hinge pin, inserted into the hinge hole, is connected the connecting bracket.

8. The continuously variable valve timing apparatus of claim 7, wherein the control portion comprises:

a control gear connected to at least one of the slider housings; and a control motor engaged with the control gear.

9. The continuously variable valve timing apparatus of claim 8, wherein the control gear is disposed under the at least one of the slider housings.

10. The continuously variable valve timing apparatus of claim 7, wherein a stopper is formed to at least one of the slider housings for limiting movement of the at least one of the slider housings.

11. An engine comprising:

a camshaft;

a plurality of wheels mounted to the camshaft, wherein a wheel key is formed to each wheel of the plurality of wheels;

a plurality of cam portions, wherein a cam and a cam key are formed to each cam portion of the plurality of cam portions and wherein the camshaft is inserted to each cam of the cam portions;

a plurality of inner brackets wherein a first sliding pin hole and a second sliding pin hole are formed to the inner brackets and wherein the inner brackets are connected with each wheel key of the plurality of wheels and each cam key of the plurality of cam portions;

a plurality of slider housings, wherein each inner bracket of the plurality of inner brackets is rotatably inserted to the slider housings, and wherein the slider housings are rotatable around a hinge hole formed to an upper side of a cam cap;

first pins having a wheel key slot, wherein the each wheel key is slidably inserted into the wheel key slot, and wherein the first pins are rotatably inserted into each first sliding pin hole of the plurality of inner brackets;

second pins having a cam key slot, wherein the each cam key is slidably inserted into the cam key slot, wherein the cam key slot is formed opposite to the wheel key slot, and wherein the second pins are rotatably inserted into each second sliding pin hole of the plurality of inner brackets; and a control portion configured for selectively moving the slider housings to change a position of a rotation center of the respective inner bracket around the hinge hole.

12. The engine of claim 11, wherein parts of the each first sliding pin hole and the each second sliding pin hole are opened for movements of the each wheel key and the each cam key not to be interrupted.

13. The engine of claim 10, further comprising:

a bearing inserted between the each slider housing and the each inner bracket.

14. The engine of claim 11, wherein the slider housings are connected each other through a slider housing connecting rod and a connecting bracket; and wherein a hinge pin, inserted into the hinge hole, is connected the connecting bracket.

15. The engine of claim 14, wherein the control portion comprises:

a control gear connected to at least one of the slider housings; and a control motor engaged with the control gear and selectively rotating the control gear.

16. The engine of claim 14, wherein a stopper is formed to at least one of the slider housings for limiting movement of the at least one of the slider housings.

* * * * *